US005911346A

United States Patent [19]

Onken

[11] Patent Number: 5,911,346

[45] Date of Patent: Jun. 15, 1999

[54] GREASE CONTAINER HAVING A DRIP-FREE LIP ALONG A POURING EDGE

[75] Inventor: Donald R. Onken, Easton, Ill.

[73] Assignee: Onken Enterprises, Easton, Ill.

[21] Appl. No.: 09/009,258

[22] Filed: Jan. 20, 1998

[51] Int. Cl.[6] ..... B65D 5/72

[52] U.S. Cl. ..... 222/571; 220/DIG. 5

[58] Field of Search ..... 222/109, 531; 414/408; 220/DIG. 5, 658

[56] References Cited

U.S. PATENT DOCUMENTS 4,538,512 9/1985 Blough ..... 220/DIG. 5

5,566,861 10/1996 Serano ..... 222/571 X

*Primary Examiner*—Gregory L. Huson

*Attorney, Agent, or Firm*—Edwin E. Greigg; Ronald E. Greigg

[57] ABSTRACT

A grease collection container which is provided with an upstanding or protruding ridge along a pouring end surface of the container. The upstanding ridge extends upward from a lip along a front wall of the container. The ridge extends upwardly from the inside surface so that the ridge is along a back portion of the lip. The upstanding ridge may be formed along each of the side walls adjoining the front wall. The upstanding ridge prevents dripping of the grease due to pouring the grease from the container.

4 Claims, 2 Drawing Sheets

GREASE CONTAINER HAVING A DRIP-FREE LIP ALONG A POURING EDGE

BACKGROUND OF THE INVENTION

This invention is directed to a grease container having an upstanding edge which is sufficiently high that the grease does not fall onto a normal reinforced edge of the container.

It is well known that fast food restaurants change their cooking grease periodically. The grease in the cooking vat is drained or in some way removed from the cooker and stored in a grease container or outside of the building for later removal by a truck for recycling. These holding containers are provided with a flat reinforced edge which projects outwardly from the sides of the container. During removal of the grease, the container is tipped so that the grease slides over the flat edge to be emptied into the truck and upon completion of the dumping, the container is set down onto the ground, whereupon the grease usually descends over the lip and down onto the sides of the grease container to create an unsightly mess. Persons who dump grease into the container then risk getting that grease on themselves.

Heretofore, grease containers have included an outwardly extending lip which not only reinforces the edge but forms an outwardly extending edge about which a depending lip on the cover rests to close the container. U.S. Pat. No. 5,031,796 sets forth a garbage container which illustrates edge 8 on an upper opening of the receiving vessel which is defined toward the outside by a collar-like profiled reinforcing edge. An edge in alignment with the side walls extends slightly above the reinforcing edge such that the edge of the cover will fit outside of the raised edge so that the cover fits onto the lip and surrounds the slightly raised edge. U.S. Pat. No. 3,727,438 sets forth a tool box which has an upwardly extending portion of the surrounding wall that forms a shoulder upon which the edge of the top rests in order to close the tool box.

In the grease container art, the grease containers include an outwardly extending lip which is horizontal and at a right angle with the wall such that the upper surface of the wall is flat. Due to the flatness of the upper wall surface the grease drips off the flat surface at the end of the process in pouring the grease from the container so that a greasy mess occurs on the side of the container which eventually ends up on the ground or other surface on which the grease container is placed.

BRIEF SUMMARY OF THE INVENTION

This invention is directed to an improved grease container to which an upstanding lip has been fixed so that when the grease is poured from the container the grease falls from the upstanding lip into the transport carrier tank. The upstanding lip is thin and the grease slides off the lip in a sheeting action without touching the outwardly extending reinforcing edge.

OBJECT OF THE INVENTION

It is therefore an object of the invention to provide an upstanding lip along a pouring edge of a grease container so that the grease falls from the upstanding lip without making a mess along the side of the container.

The invention will be better understood and further objects and advantages thereof will become more apparent from the ensuing detailed description of preferred embodiments taken in conjunction with the drawings.

DETAILED DESCRIPTION OF THE DRAWINGS

Figure 1:
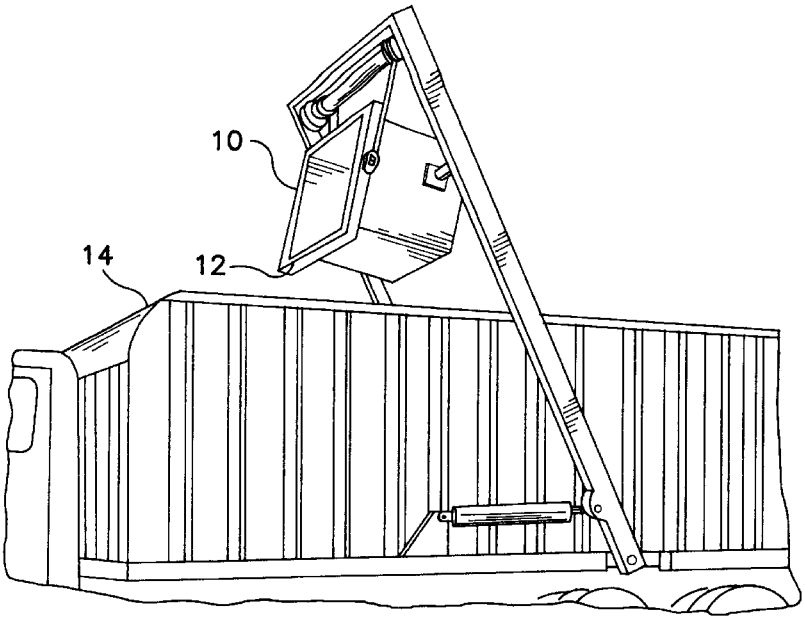
FIG. 1 illustrates a prior art grease container shown in a pouring position relative to a disposal truck which is shown only partially.

Now referring to the drawings there is shown in FIG. 1 a prior art grease container which has been lifted by a lift in order to pour the grease from the grease container. As shown, the grease container 10 has a bottom with four upstanding walls. The upper surface of the walls are provided with an outwardly extending flat lip 12 which reinforces the grease container and eliminates sharp edges. The grease container is shown with the grease container in a position in which the grease is poured from the container into a much larger transport carrier 14 for disposal of the grease. As set forth previously, at the beginning and at the end of pouring the grease from the known grease container the grease drips off the flat lip and along the sides of the grease container. This creates a greasy mess when the grease container is placed back into the normal rest position.

Figure 2:
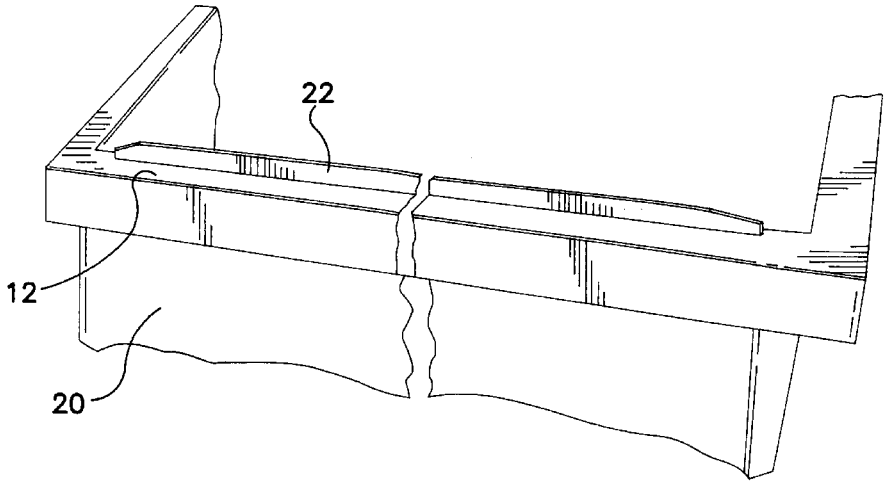
FIG. 2 illustrates a front and side edge of a grease container in accordance with the present invention.

FIG. 2 illustrates a grease container 20 having the usual flat lip 12 in which the container has been provided with an upstanding ridge 22. The upstanding ridge is an extension of the inner wall surface which protrudes upwardly from the back portion of the flat lip 12. The upstanding ridge extends across the width of the container from one inside wall to the other inside wall of the container. As shown in FIG. 2, the ends of the ridge could end at a point just before reaching the inner side walls to provide an insert area in which a bottom portion of the cover-lid could fit in order to close the cover-lid tighter.

The sides of the container which extend back from the front wall to the back wall can be provided with an upstanding ridge which corresponds with the ridge along the front wall.

Figure 3:
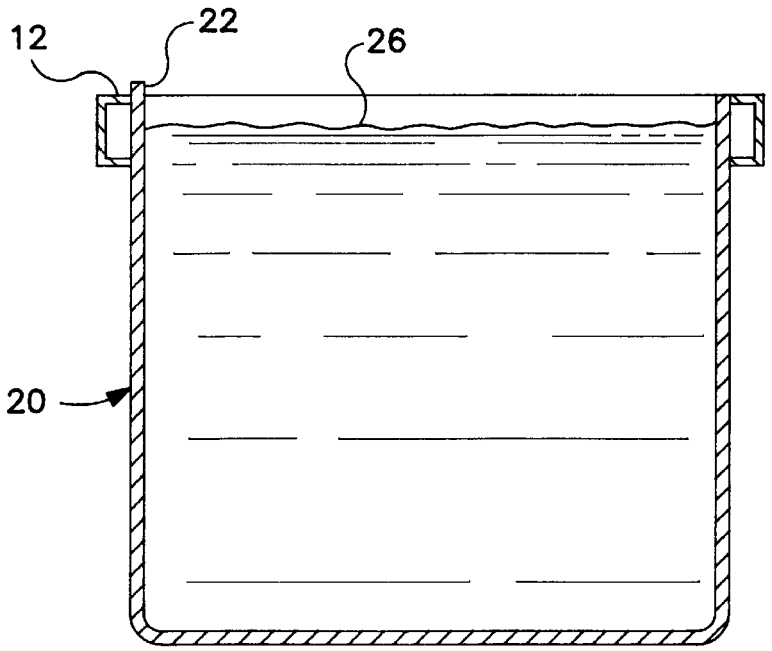
FIG. 3 is a diagrammatic view of the partial cross section view which illustrates the upstanding ridge.

FIG. 3 is a diagrammatic partial cross-sectional view which illustrates the container of FIG. 2 with the grease container in a normal upright position. The lip 12 and the upstanding ridge 22 are shown more clearly than in FIG. 2.

Figure 4:
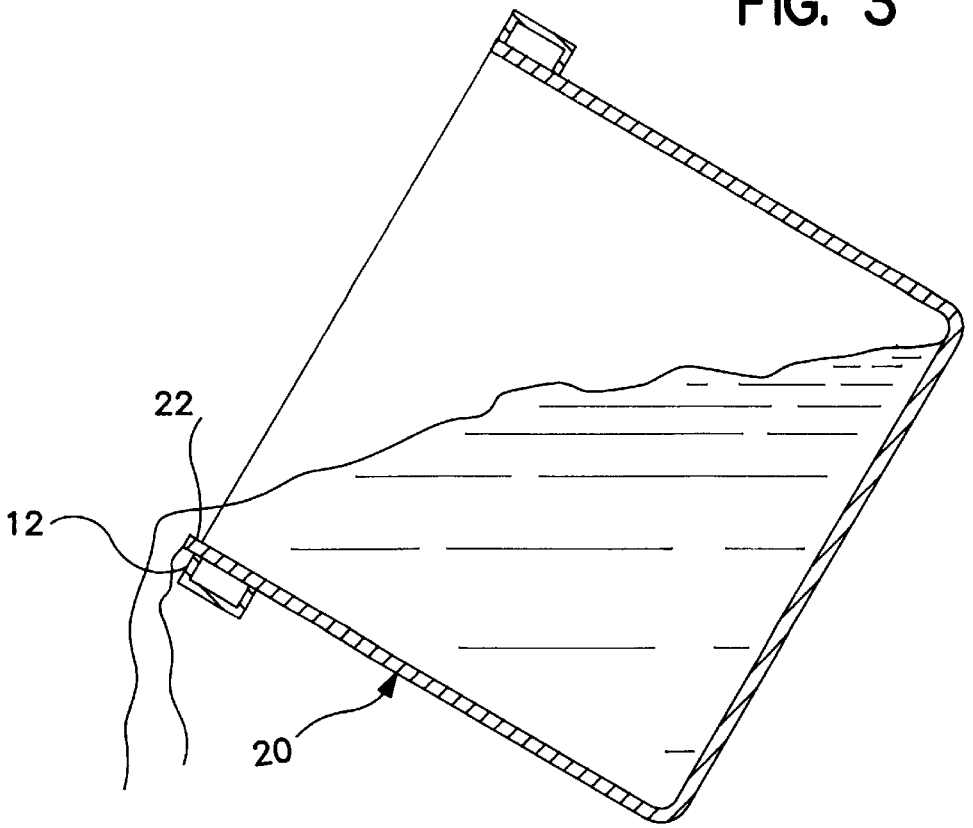
FIG. 4 is a partial diagrammatic view which illustrates the container of FIGS. 2 and 3 in a position for pouring the grease from the container.

FIG. 4 illustrates the grease container in a grease pouring position. FIG. 4 illustrates the grease 26 flowing over the upstanding ridge so that the grease does not flow onto the lip 12. By an addition of the upstanding ridge, the grease flows over the ridge in a sheeting action without dripping onto the lip 12. Thus, the grease is cleanly poured into the container of the tanker so that when the container is placed back onto the ground there will be virtually no grease that flows from the lip down onto the front side of the container.

The upstanding ridge 22 lip extends upwardly from the lip 12 so that the upper edge is rounded into a somewhat sharp edge, but yet an edge which is not sharp enough to cut or injure a person working with the container. The rounded-sharp edge permits the grease to flow smoothly over the upper edge without any of the grease dripping downwardly toward the lip 12.

In operation, the grease from a kitchen is disposed of by pouring it into the grease container 10. The grease container is then lifted and placed into a hot water tank of the disposal tanker truck which causes the grease along the sides of the container to soften to a somewhat fluid state. The grease container is then lifted from the hot water tank and the container then is tilted so that the softened grease may be poured into a grease collection tank. Once the grease has been completely poured from the container into the collection tank of the container it is tilted back into a normally upright position and lowered back onto the ground. The upstanding ridge prevents the grease from dripping during pouring into the grease collection tank so that there are no drippings on the ground after the container is lowered onto the ground.

The foregoing relates to preferred exemplary embodiments of the invention, it being understood that other variants and embodiments thereof are possible within the spirit and scope of the invention, the latter being defined by the appended claims.

What is claimed is:

1. A grease container having a drip-free edge which prevents grease from dripping during pouring the grease from the container into a transport tank which comprises a grease storage container, said grease storage container having a flat lip which extends outwardly from an upper edge of a front wall of said container, an upstanding ridge along said lip, said upstanding ridge extending upwardly from an inner surface of said front wall at a back portion of said lip thereby forming an angle with said lip.

2. A grease container as set forth in claim 1, in which said upstanding ridge extends substantially along an entire width of said front wall.

3. A grease container as set forth in claim 2, in which each side wall of said container is provided with an upstanding ridge along an upper wall surface thereof.

4. A grease container as set forth in claim 2, in which said upstanding ridge extends along an entire width of said front wall.

* * * * *